US007689158B2

(12) United States Patent
Sato et al.

(10) Patent No.: US 7,689,158 B2
(45) Date of Patent: Mar. 30, 2010

(54) IMAGE FORMING APPARATUS HAVING IMAGE READING FUNCTION

(75) Inventors: Shougo Sato, Seto (JP); Naoya Kamimura, Nagoya (JP); Shigeharu Katayama, Kakamigahara (JP); Hidenori Hisada, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 512 days.

(21) Appl. No.: 11/555,598

(22) Filed: Nov. 1, 2006

(65) Prior Publication Data

US 2007/0134036 A1 Jun. 14, 2007

(30) Foreign Application Priority Data

Dec. 8, 2005 (JP) ..... 2005-355022

(51) Int. Cl.
*G03G 15/00* (2006.01)

(52) U.S. Cl. ..... 399/367; 399/12; 399/381

(58) Field of Classification Search ..... 399/361; 16/42 R; 248/188.9
See application file for complete search history.

(56) References Cited

U.S. PATENT DOCUMENTS

2003/0098984 A1* 5/2003 Botten et al. ..... 358/1.4
2005/0053394 A1* 3/2005 Ishii et al. ..... 399/111
2005/0194731 A1* 9/2005 Ohama et al. ..... 271/10.11

FOREIGN PATENT DOCUMENTS

| | | | | |
|---|---|---|---|---|
| JP | H09200399 | A | | 7/1997 |
| JP | H09311514 | A | | 12/1997 |
| JP | H11119496 | A | | 4/1999 |
| JP | H11289411 | A | | 10/1999 |
| JP | 2000079028 | A | * | 3/2000 |
| JP | 2001063175 | A | | 3/2001 |
| JP | 2005221648 | A | * | 8/2005 |
| JP | 2005238707 | A | * | 9/2005 |

* cited by examiner

*Primary Examiner*—Judy Nguyen
*Assistant Examiner*—Allister Primo
(74) *Attorney, Agent, or Firm*—Baker Botts L.L.P.

(57) ABSTRACT

An image forming apparatus includes an apparatus main body and an original reading device disposed on top of the apparatus main body. A sheet supply cassette, a sheet discharge tray, an original feed tray, and the original discharge tray are oriented such that their lengthwise directions are aligned with the first horizontal direction, and are arranged to overlap with one another in the vertical direction. A pair of side walls is disposed at both widthwise ends of the sheet supply cassette, the sheet discharge tray, the original feed tray, and the original discharge tray. The both widthwise ends of these components are formed as edge portions. The pair of side walls covers an entire length of each of the edge portions, thereby supporting all of the sheet supply cassette, the sheet discharge tray, the original feed tray, and the original discharge tray.

12 Claims, 11 Drawing Sheets

IMAGE FORMING APPARATUS HAVING IMAGE READING FUNCTION

CROSS REFERENCE TO RELATED APPLICATIONS

This application claims priority from Japanese Patent Application No. 2005-355022 filed Dec. 8, 2005. The entire content of the priority application is incorporated herein by reference.

TECHNICAL FIELD

The disclosure relates to an image forming apparatus having an image reading function.

BACKGROUND

Conventionally, various image forming apparatuses having the image reading function have been proposed. For example, in an image forming apparatus disclosed in Japanese Patent Application Publication No. 9-200399, an original reading unit has a casing which accommodates an imaging device such as an image sensor therein, and an original tray and an original discharge tray are fixed to a side wall of the casing so that ends thereof contact the side wall. When an original is sent from the original tray, an image on the original is read in the casing. Then, the original is discharged onto the original discharge tray.

SUMMARY

In recent years, with miniaturization of the image forming apparatus, for example, there is a demand to use the whole apparatus in a shelf. On the other hand, with conventional configuration, the original reading unit, especially the tray is mostly exposed to the outside. Thus, in putting in or taking out the image forming apparatus, when the image forming apparatus hits against an upper wall or a side wall of the shelf by mistake, the tray exposed to the outside is directly subjected to strong impact. As a result, the tray may be broken or deformed. Thus, there is room for improvement in this matter.

In view of the foregoing, it is an object of one aspect of the invention to provide an image forming apparatus which has less irregularity (i.e., less protrusions and depressions) and can be placed in relatively small space such as a shelf.

In order to attain the above and other objects, the invention provides an image forming apparatus having an image reading function. The image forming apparatus includes an apparatus main body and an original reading device disposed on top of the apparatus main body. The apparatus main body includes a main casing, a sheet supply cassette, an image forming unit, a sheet discharge tray, and a sheet discharge mechanism. The main casing has one end and another end opposite the one end in a first horizontal direction. The main casing has both widthwise ends in a second horizontal direction perpendicular to the first horizontal direction. Both the first horizontal direction and the second horizontal direction are horizontal and are perpendicular to a vertical direction when the image forming apparatus is disposed in an orientation in which the image forming apparatus is intended to be used. The main casing is formed with a sheet discharge opening. The sheet supply cassette is detachably mounted in the main casing. The sheet supply cassette is configured to accommodate a plurality of sheets in a stacked arrangement. The image forming unit is disposed in the main casing. The image forming unit is configured to form an image on a sheet supplied from the sheet supply cassette. The sheet discharge tray is disposed above the sheet supply cassette at an overlapping position with the sheet supply cassette in the vertical direction. The sheet discharge opening is positioned at an another end side of the sheet discharge tray. The sheet discharge mechanism is disposed in the main casing. The sheet discharge mechanism is configured to discharge the sheet, on which an image is formed, onto the sheet discharge tray through the sheet discharge opening. The original reading device includes an original-reading-device main body, an original feed tray, an image reading unit, an original conveying mechanism, an original discharge tray, an original discharge mechanism, and a pair of tray holding members. The original-reading-device main body is formed with an original discharge opening. An original is placed on the original feed tray. The image reading unit is disposed in the original-reading-device main body. The image reading unit is configured to read an image on the original. The original conveying mechanism is disposed in the original-reading-device main body. The original conveying mechanism is configured to convey the original placed on the original feed tray toward the image reading unit. The original discharge tray is disposed at an overlapping position with the original feed tray in the vertical direction. The original discharge opening being positioned at an another end side of the original discharge tray. The original discharge mechanism is disposed in the original-reading-device main body. The original discharge mechanism is configured to discharge the original, from which the image is read, onto the original discharge tray through the original discharge opening. The pair of tray holding members is disposed at both widthwise ends of the original feed tray and the original discharge tray in the second horizontal direction. The pair of tray holding members supports both the original feed tray and the original discharge tray at the both widthwise ends.

According to another aspect, the invention also provides an image forming apparatus having an image reading function. The image forming apparatus includes an apparatus main body and an original reading device disposed on top of the apparatus main body. The apparatus main body includes a main casing, a sheet supply cassette, an image forming unit, a sheet discharge tray, and a sheet discharge mechanism. The main casing has one end and another end opposite the one end in a first horizontal direction. The main casing has both widthwise ends in a second horizontal direction perpendicular to the first horizontal direction. Both the first horizontal direction and the second horizontal direction are horizontal and are perpendicular to a vertical direction when the image forming apparatus is disposed in an orientation in which the image forming apparatus is intended to be used. The sheet supply cassette is detachably mounted in the main casing. The sheet supply cassette is configured to accommodate a plurality of sheets in a stacked arrangement. The image forming unit is disposed in the main casing. The image forming unit is configured to form an image on a sheet supplied from the sheet supply cassette. The sheet discharge mechanism is disposed in the main casing. The sheet discharge mechanism is configured to discharge the sheet, on which an image is formed, onto the sheet discharge tray. The original reading device includes an original feed tray, an image reading unit, an original conveying mechanism, an original discharge tray, and an original discharge mechanism. An original is placed on the original feed tray. The image reading unit is configured to read an image on the original. The original conveying mechanism is configured to convey the original placed on the original feed tray toward the image reading unit. The original discharge mechanism is configured to discharge the original, from which the image is read, onto the original discharge tray. All of the sheet supply cassette, the sheet discharge tray, the original feed tray, and the original discharge tray are oriented such that their lengthwise directions are aligned with the first horizontal direction, and are arranged to overlap with one another in the vertical direction. The image forming apparatus further includes a pair of side walls disposed at both widthwise ends, in the second horizontal direction, of the sheet supply cassette, the sheet discharge tray, the original feed tray, and the original discharge tray. The both widthwise ends of each of the sheet supply cassette, the sheet discharge tray, the original feed tray, and the original discharge tray are formed as edge portions that extend in the first horizontal direction. The pair of side walls covers an entire length of each of the edge portions, thereby supporting all of the sheet supply cassette, the sheet discharge tray, the original feed tray, and the original discharge tray.

BRIEF DESCRIPTION OF THE DRAWINGS

Illustrative aspects in accordance with the invention will be described in detail with reference to the following figures wherein.

DETAILED DESCRIPTION

<First Aspect>

An image forming apparatus according to a first aspect of the invention will be described with reference to FIG. 1 through FIG. 5. In the following description, the expressions "front", "rear", "upper", "lower", "right", and "left" are used to define the various parts when the image forming apparatus is disposed in an orientation in which it is intended to be used.

Figure 1:
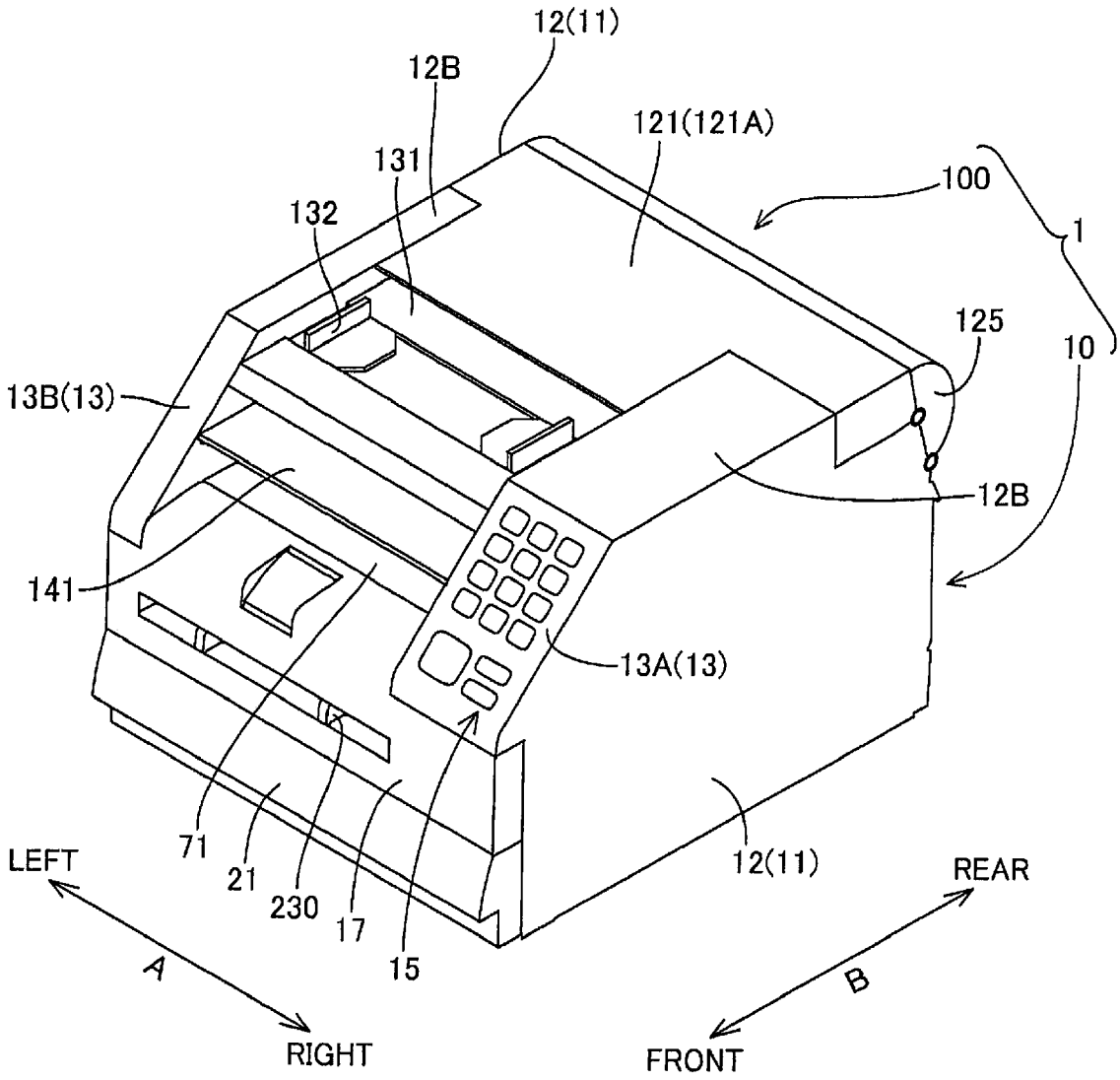
FIG. 1 is a perspective view of a multifunction apparatus according to a first aspect of the invention.
Figure 2:
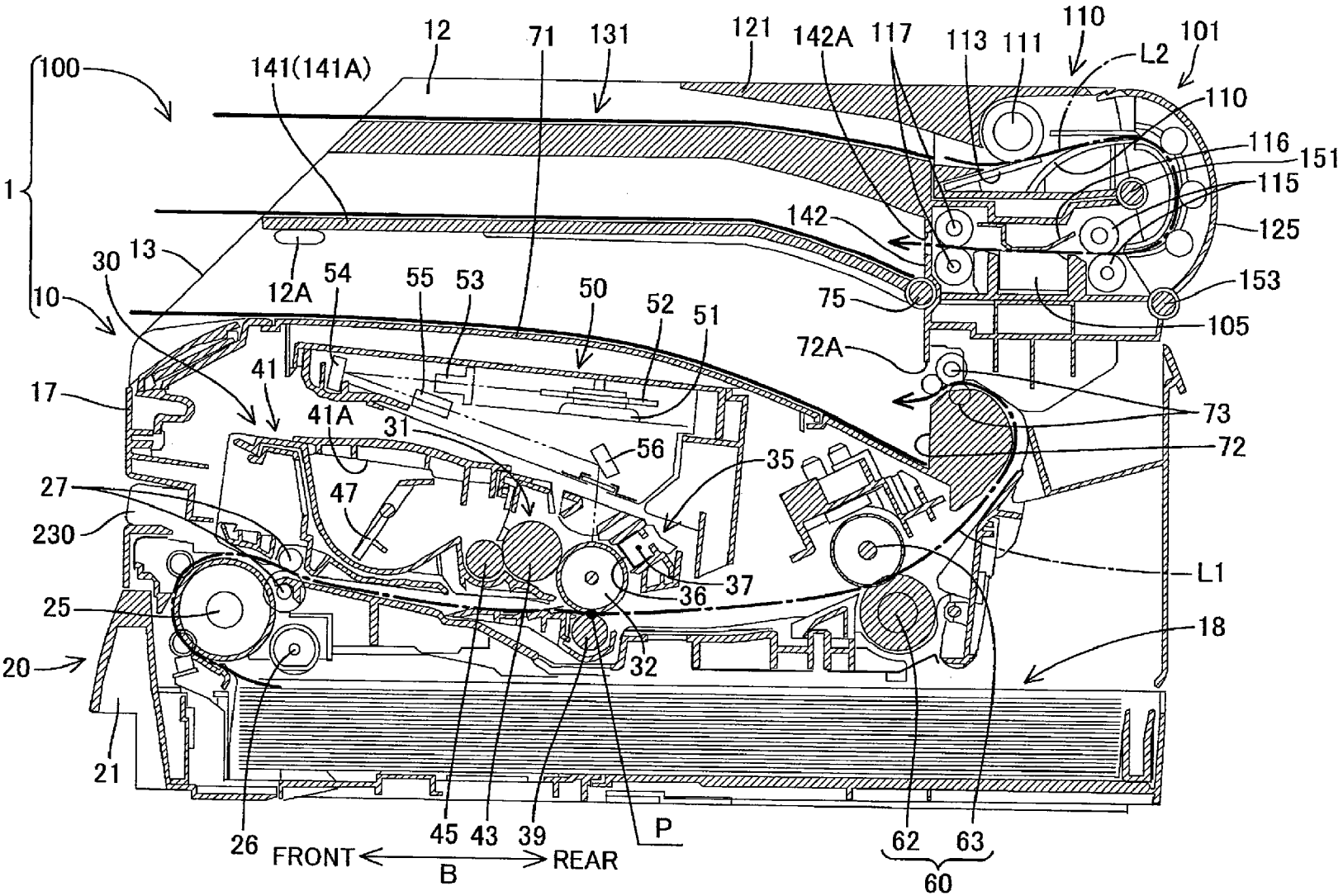
FIG. 2 is a vertical cross-sectional view of the multifunction apparatus.

FIG. 1 is a perspective view of a multifunction apparatus 1 according to the first aspect. FIG. 2 is a vertical cross-sectional view of the multifunction apparatus 1. In the following description, A direction of an arrow A and a direction of an arrow B in FIG. 1 are defined as a width direction and a depth direction (front-rear direction) of a main body of the apparatus, respectively. A surface on which an operation panel 15 is provided is defined as a front surface (front side) of the apparatus.

The multifunction apparatus 1 includes an apparatus main body 10 and an image reading device 100 for reading an original image. Devices (described later) constituting the apparatus main body 10 and the image reading device 100 are vertically stacked (in an overlapping arrangement) in a casing 11. The casing 11 is opened in two directions, that is, to the front and above. Briefly describing the characteristic configuration of the multifunction apparatus 1, the apparatus main body 10 has a sheet supply cassette 21 and a recording-sheet discharge tray (sheet discharge tray) 71. The image reading device 100 has an original discharge tray 141 and an original feed tray 131. The sheet supply cassette 21, recording-sheet discharge tray 71, original discharge tray 141, and original feed tray 131 are stacked (in an overlapping arrangement) in this order from the bottom so that the longitudinal direction corresponds to the depth direction (front-rear direction) of the apparatus (the direction B in FIG. 1).

Side walls 12 (tray holding members) of the casing 11 are located over the entire height and depth (the entire length from the front end to the rear end) on both widthwise sides of the trays 71, 131, and 141 and the sheet supply cassette 21 to hold the trays 71, 131, and 141 and the sheet supply cassette 21. As a result, the apparatus has a substantially box-like shape as a whole.

The original feed tray 131 extends between the right and left side walls 12 of the casing 11. A pair of side guides 132 is provided near the front part of the original feed tray 131. An upper cover 121 is provided near the rear end of the original feed tray 131. The side guides 132 serve to correct slanting of the original in the width direction by sandwiching the original from the both sides thereof.

An upper surface 121A of the upper cover 121 is flush (i.e., positioned on the same imaginary plane) with upper edges 12B of the casing 11. More specifically, the right and left side walls 12 of the casing 11 protrude upward from the original feed tray 131 in the vertical direction and upper ends of the protruded part are flat surfaces 12B. The upper surface 121A of the upper cover 121 is flush with the flat surfaces 12B. With such configuration, the upper surface of the multifunction apparatus 1 becomes the flat bearing surface and for example, can place an object thereon.

As shown in FIG. 1, an upper front end (the upper-front corner portion) of the multifunction apparatus 1 is obliquely cut off across the width. In other words, the front ends of the original feed tray 131 and the original discharge tray 141 are cut to make the length (in the front-rear direction) of the trays shorter. Specifically, the upper front end of the multifunction apparatus 1 is cut so that the lengths of the trays 131 and 141 are shorter than that of a standard original (for example, A4 size). With such configuration, the original can be easily set. Furthermore, when the original is discharged, the front end of the original protrude forward as shown in FIG. 2 and thus, the original can be easily taken out.

Using an inclined plane 13 on the front surface of the multifunction apparatus 1, an operation panel 15 is provided. Specifically, a right inclined plane 13A in FIG. 1 is wider than a left inclined plane 13B and the operation panel 15 is disposed on almost whole of the wider right inclined plane 13A. By operating the operation panel 15, setting such as the number of sheets to be copied can be variously changed. The slantly-cut front surface of the apparatus is also effective for preventing danger.

A front cover 17 is hingedly secured to the casing 11 by a hinge (not shown) provided at the lower front surface of the casing 11. The front cover 17 is usually in a closed state in which the front surface of the casing 11 is closed (see FIG. 2). However, in response to a predetermined operation, the front cover 17 pivotally moves about the hinge to open the front surface of the casing 11 (see FIG. 3).

On the other hand, a rear end cover 125 is provided at an upper rear end of the casing 11. An arc-like original conveying path L2 is formed in the rear end cover 125. Hereinafter, configuration of each part will be specifically described.

<Image Forming Apparatus Main Body>

The apparatus main body 10 is a so-called electrophotographic laser printer and mainly includes a feeder unit 20 for sending recording sheets one sheet at a time, a process unit 30, a scanner unit 50 serving as an exposing unit, and the recording-sheet discharge tray 71. These parts are arranged in this order from the bottom. The process unit 30 and the scanner unit 50 constitute an image forming unit.

As shown by a single-dot chain line in FIG. 2, above and front of the feeder unit 20, a recording-sheet conveying path L1 turns around from the front side toward the rear side by approximately 180 degrees in a substantially U-shape, and then leads to the rear portion of the multifunction apparatus 1. When reaching the rear end of the multifunction apparatus 1, the conveying path L1 turns around toward the front side by approximately 180 degrees in a substantially U-shape and takes a course to the recording-sheet discharge tray 71. While the recording sheet sent from the feeder unit 20 is conveyed on the conveying path L1, a toner image is formed on the recording sheet and the toner image is thermally fixed by a fixing unit 60, thereby forming a desired image.

The feeder unit 20 has a sheet supply cassette 21 shaped like a thin tray. The sheet supply cassette 21 accommodates recording sheets as recording mediums in a stacked manner therein so that the longitudinal direction of the recording sheets is oriented in the depth direction of the apparatus. The sheet supply cassette 21 is configured to be mounted in or dismounted from a cassette accommodating portion 18 provided at the bottom of the casing 11 by an operation from the front surface side of the apparatus.

A sheet feeding roller 25, a sending roller 26, and conveying rollers 27 are provided in a lower front portion of the casing 11 and on the front surface side of the sheet supply cassette 21. The sheet feeding roller 25 and sending roller 26 pull out the recording sheets from the sheet supply cassette 21 one sheet at a time toward the front surface side and then, in cooperation with the conveying rollers 27, send the recording sheet to the conveying path L1 while changing the direction toward the rear side of the casing 11. A manual feed tray 230 is also provided for manually feeding a recording sheet.

The process unit 30 is located above the sheet supply cassette 21 and in the front portion of the apparatus and has a drum cartridge 31 and a developing cartridge 41. As shown in FIG. 2, the drum cartridge 31 has a photosensitive drum 32, a charger 35, and a transfer roller 39. The photosensitive drum 32 is shaped like a cylinder extending along the width direction of the recording sheet (the direction perpendicular to the sheet of FIG. 2). The surface of the photosensitive drum 32 is formed of a positively-charged photoconductive layer made of polycarbonate or the like. The photosensitive drum 32 is rotatably driven by a driving force of a main motor (not shown).

The charger 35 is a so-called scorotron type charger and formed of a shield case 36 also used as a grid and a charging wire 37 accommodated in the shield case 36. A high voltage is applied to the charging wire 37, thereby generating corona discharge. By applying a constant voltage to the grid at the time of discharge, the surface of the photosensitive drum 32 is positively charged in an uniform manner.

The transfer roller 39 is located below the photosensitive drum 32 so as to confront each other. The transfer roller 39 is formed by covering a metal roller shaft with a roller made of an ion-conductive rubber material. At the time of transfer, transfer bias (transfer forward bias) is applied to the transfer roller 39.

The developing cartridge 41 has a developing roller 43 and a supply roller 45 which are located in a lower portion of a toner accommodating member 41A which accommodates toner therein. The developing roller 43 and the supply roller 45 are disposed so as to confront each other. In the toner accommodating member 41A, an agitator 47 for agitating toner is provided. The toner discharged from the toner accommodating member 41A is supplied to the developing roller 43 by rotation of the supply roller 45. While the toner passes between the both rollers, the toner is frictionally charged to the positive potential due to friction with rotation. The frictionally charged toner is supplied to the photosensitive drum 32 by the developing roller 43.

Figure 3:
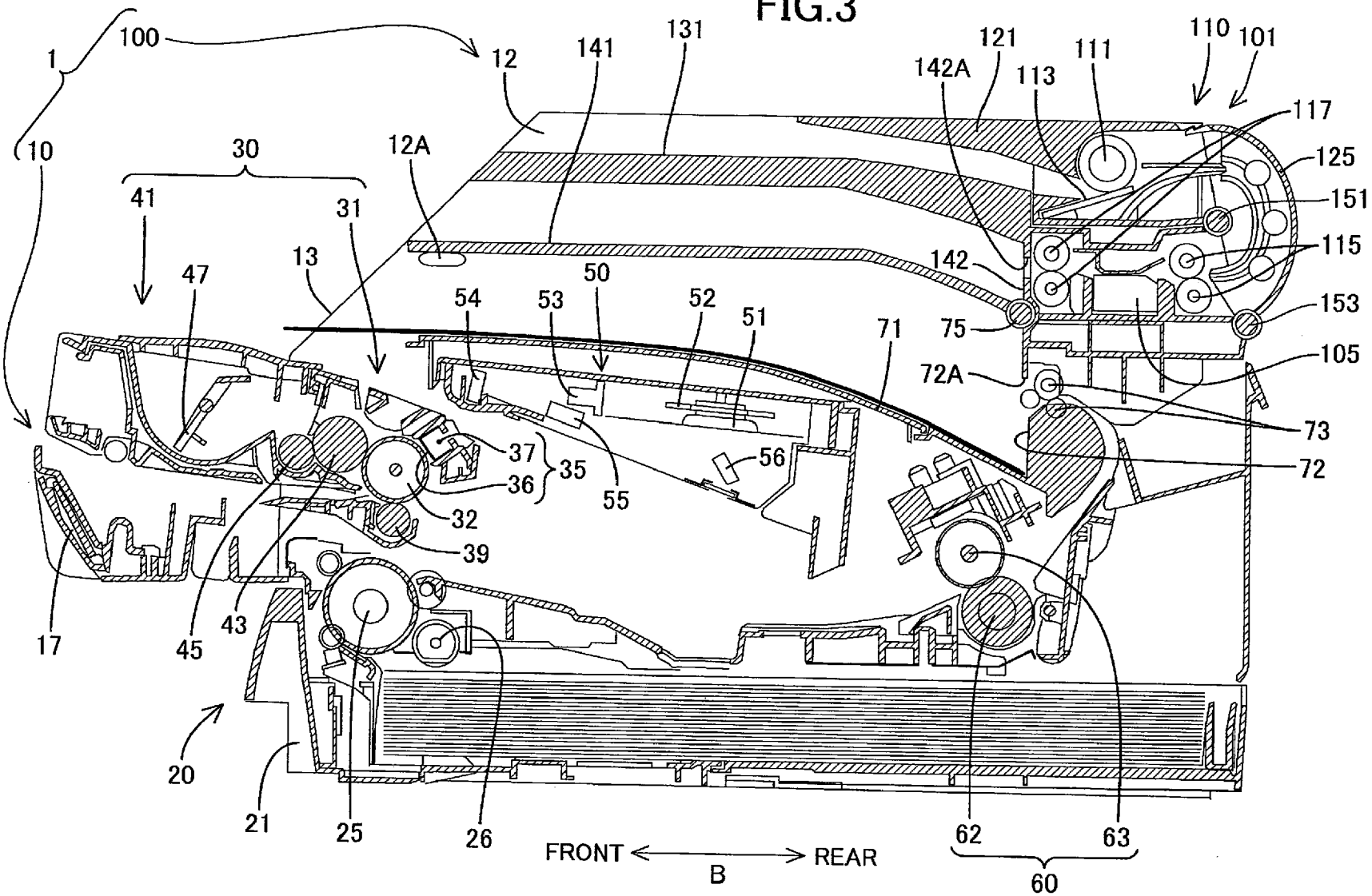
FIG. 3 is a vertical cross-sectional view showing a mounting/dismounting operation of a process unit.

As described above, although the front surface of the casing 11 is usually closed with the front cover 17, the front surface can be opened as shown in FIG. 3 by performing a predetermined operation. The process unit 30 can be inserted in or removed from the opened front surface by operation on the front surface side of the apparatus.

Next, the scanner unit 50 serving as an exposing unit will be described.

The scanner unit 50 is provided above the process unit 30 and has a laser emitting part (not shown), a polygon mirror 52 rotatably driven by a polygon motor 51, lenses 53 and 55, and reflection mirrors 54 and 56.

A laser beam emitted from the laser emitting part is reflected on the polygon mirror 51 driven by the polygon motor 51 in a predetermined direction. After that, the reflected light passes the lens 53 and in turn, the reflection mirror 54, the lens 55, and the reflection mirror 56 in this order (through a path shown by a two-dot chain line in FIG. 2) and is scanned on the surface of the photosensitive drum 32 in a high-speed scanning motion.

Next, the fixing unit 60 will be described.

The fixing unit 60 is provided in the rear of the process unit 30. The fixing unit 60 includes a heating roller 63 and a pressing roller 62 which is disposed in confrontation with the heating roller 63. The heating roller 63 has a halogen lamp (not shown) for heating and serves to thermally fix the toner image (developer image) transferred on the recording sheet by the transfer roller 39 while the recording sheet passes between the heating roller 63 and the pressing roller 62.

The recording-sheet discharge tray 71 is provided above the fixing unit 60. Right and left side edges of the recording-sheet discharge tray 71 are held by the side walls 12 of the casing 11. The recording-sheet discharge tray 71 is gradually inclined downward toward the rear end of the apparatus. A sheet discharge opening 72A (sheet discharge opening) is formed on a rear wall 72. Sheet discharge rollers 73 (sheet discharge mechanism) are provided further in the rear of the sheet discharge opening 72A.

Briefly describing a series of image forming operations, first, the surface of the photosensitive drum 32 is positively charged by the charger 35 uniformly while rotating. After that, when predetermined image data is inputted from a host device, for example, control based on the image data is started and a laser beam is irradiated from the scanner unit 50 onto the photosensitive drum 32. Thus, a predetermined electrostatic latent image according to the image data is formed on the surface of the photosensitive drum 32. That is, the potential of an area to which the laser beam is irradiated, of the surface of the photosensitive drum 32 which is positively charged uniformly, is lowered (so-called exposure).

Next, by rotation of the developing roller 43, the positively charged toner borne on the developing roller 43 is supplied to the electrostatic latent image formed on the surface of the photosensitive drum 32. The electrostatic latent image on the photosensitive drum 32 is made visible and the toner image through reverse development is borne on the surface of the photosensitive drum 32.

In parallel with the above-described processing for forming the toner image, processing for conveying the recording sheet is performed. That is, with rotation of the sheet feeding roller 25, the recording sheets are sent one sheet at a time from the sheet supply cassette 21 to the conveying path L1. The recording sheet sent to the conveying path L1 is conveyed to a transfer position P (a position at which the photosensitive drum 32 is in contact with the transfer roller 39) by the conveying rollers 27.

When passing the transfer position P, by the transfer bias applied to the transfer roller 39, the toner image borne on the surface of the photosensitive drum 32 is transferred on the surface of the recording sheet. In this manner, the desired toner image is formed on the recording sheet. Then, when passing the fixing unit 60, the transferred toner image is thermally fixed.

After that, when the recording sheet on which the image is formed further moves downstream on the conveying path L1 and reaches the sheet discharge rollers 73, as shown in FIG. 2, the recording sheet is conveyed from the sheet discharge opening 72A toward the front surface side of the apparatus by the sheet discharge rollers 73 and discharged onto the recording-sheet discharge tray 71.

<Image Reading Device>

The image reading device 100 includes the original feed tray 131, the original discharge tray 141, and an image-reading-device main body 101 that accommodates a contact image sensor 105 and an ADF mechanism 110. The contact image sensor 105 (hereinafter referred to as CIS) has an image reading function. The ADF mechanism 110 is configured to convey the original placed on the original feed tray 131 to the CIS 105 and to discharge the original to the original discharge tray 141 (original conveying mechanism and original discharge mechanism). The CIS 105 constitutes an image reading unit.

As shown in FIG. 2, the original discharge tray 141 is located between the original feed tray 131 and the recording-sheet discharge tray 71. A rear end of the original discharge tray 141 is coupled to a hinge 75 provided above the rear wall 72 of the recording-sheet discharge tray 71. An original discharge opening 142A is formed at the position above the hinge 75 and on the rear wall 142 of the original discharge tray 141. Further in the rear portion of the apparatus (the right side in FIG. 2), original discharge rollers 117, the CIS 105, and conveying rollers 115 are arranged horizontally (in the front-rear direction).

Figure 4:
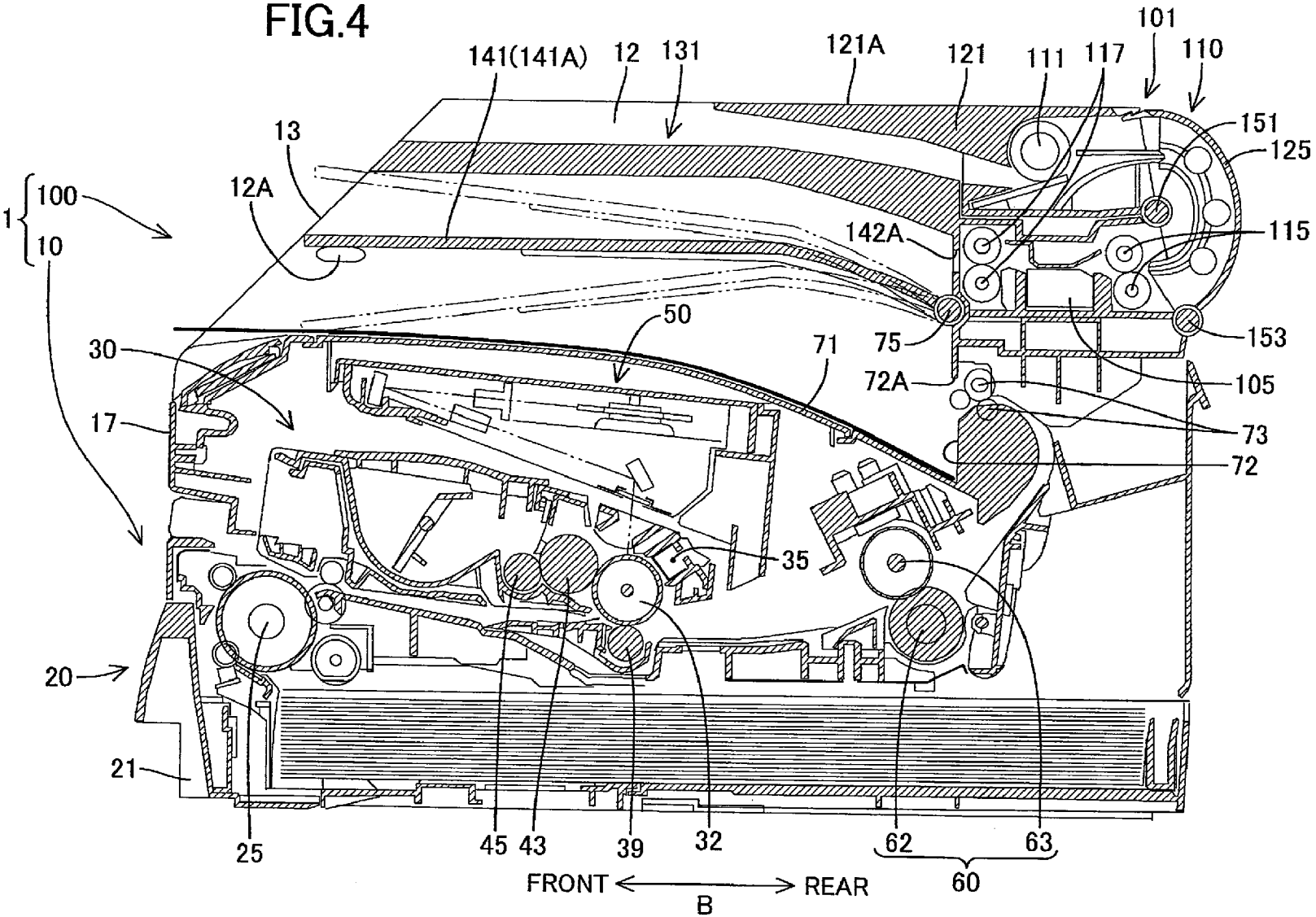
FIG. 4 is a vertical cross-sectional view showing the state where a front end of an original discharge tray is pivotally moved up and down.

On the other hand, supporting protrusions 12A are provided on each of the side walls 12 of the casing 11. By supporting the lower surface of the front end of a bottom plate 141A by the supporting protrusions 12A, the original discharge tray 141 is held in a horizontal position shown in FIG. 2. Thus, when the original discharge tray 141 is lifted with so small force as to be against the self-weight, as shown in FIG. 4, the original discharge tray 141 pivotally moves about the hinge 75 and the front end thereof moves upward. On the other hand, when a large downward force is applied, the bottom plate 141A gets over the supporting protrusions 12A, thereby enabling the bottom plate 141A to pivotally move downward.

With such configuration, according to a demand, the opening of the recording-sheet discharge tray 71 can be made large. Like the recording-sheet discharge tray 71, the original feed tray 131 and the original discharge tray 141 are gradually inclined downward from the front toward the rear.

An original conveying path L2 is formed in the upper rear end of the casing 11 and in the rear of the both trays 131 and 141. The original conveying path L2 is configured to convey the original placed on the original feed tray 131 toward the rear of the apparatus, to turn the original in a substantially U-shape, and to guide the original to the CIS 105.

The ADF mechanism 110 is formed of the original feeding roller 111, the conveying rollers 115, and the original discharge rollers 117. These rollers 111, 115, and 117 are arranged in this order from the upstream side to the downstream side of the original discharge path L2. A separating piece 113 has a function of separating the stacked originals from each other so that the original can be sent from the original feeding roller 111 one sheet at a time. An original pressing piece 116 is configured to force the original in close contact with a reading surface of the CIS 105.

The CIS 105 is a line type sensor in which a plurality of photo diodes as light receiving units are arranged in a line so that the longitudinal direction is oriented in the direction perpendicular to the original conveying direction.

The CIS 105 has a light source (not shown) as a lighting device. The light emitted from the light source is irradiated onto the original which is conveyed on the original conveying path L2 and passes the CIS 105. The reflected light is received by each photo diode.

Thus, each photo diode outputs an electrical signal of level according to light intensity (lightness) of the received light. By converting the electrical signal into digital data by an A/D converter (not shown), the original image can be read.

After reading of the original image, the original is conveyed from the original discharge opening 142A toward the front surface of the apparatus by the original discharge rollers 117 and discharged onto the original discharge tray 141. As described above, the upper front end (the upper-front corner portion) of the multifunction apparatus 1 is obliquely cut off so as to make the length of the trays 131 and 141 shorter. Accordingly, since the front end of the discharged original protrudes from the front end of the original discharge tray 141, the original after the image reading operation can be easily taken by grasping the front end.

Figure 5:
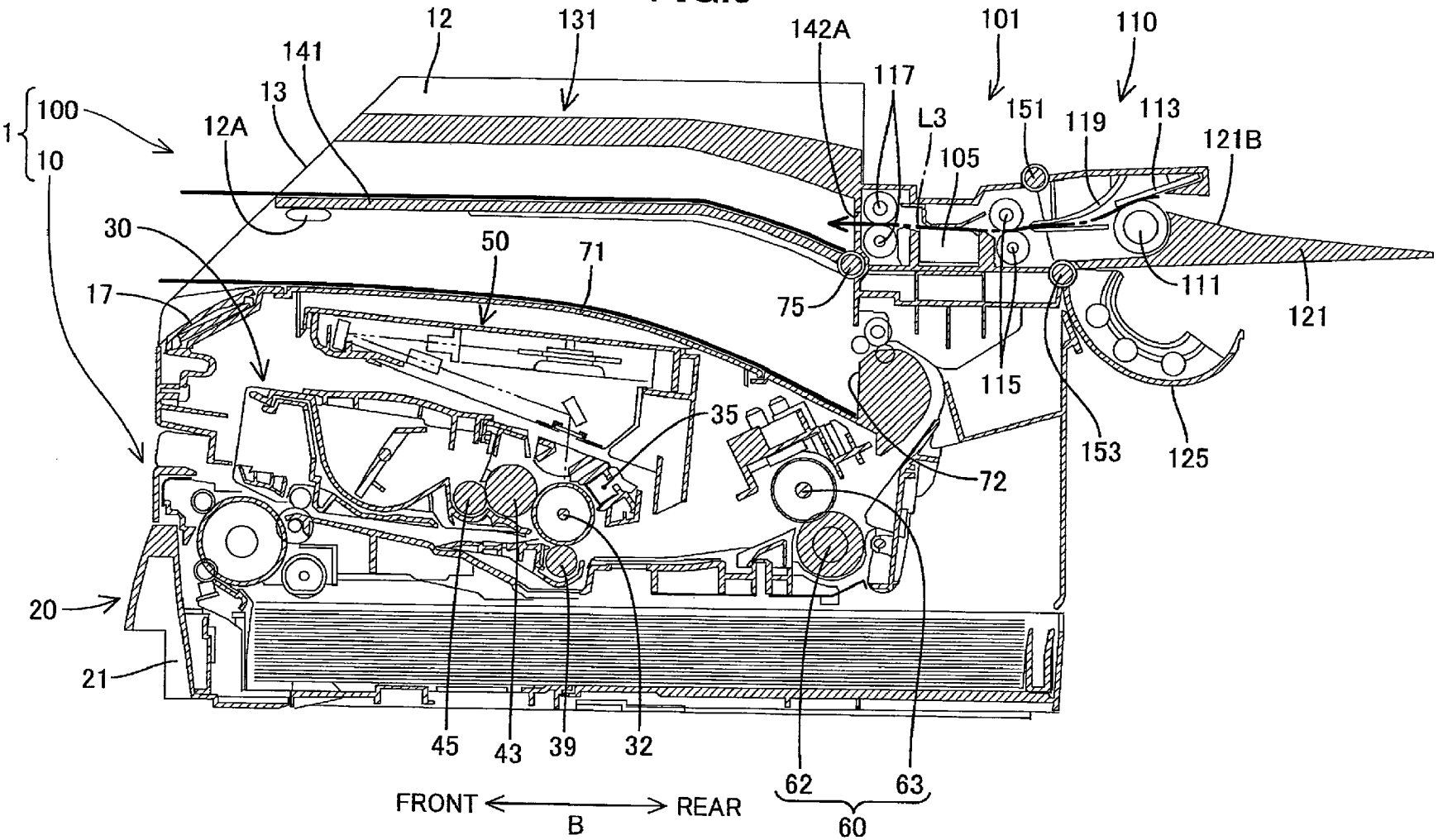
FIG. 5 is a vertical cross-sectional view showing a straight conveying path.

In this aspect, in addition to the above-mentioned original conveying path L2, a straight conveying path L3 is provided. As shown in FIG. 5, the rear end cover 125 can be pivotally moved about a second hinge 153 by approximately 180 degrees toward the rear. When the cover 125 is opened, the upper cover 121 can be also pivotally moved toward the rear.

That is, the upper cover 121 is coupled to the casing 11 with a first hinge 151 and can be pivotally moved about the first hinge 151 by approximately 180 degrees toward the rear of the apparatus. When the upper cover 121 is pivotally moved, the original feeding roller 111, the separating piece 113, and a sheet guide 119 are also moved integrally with the upper cover 121.

Thus, a back surface 121B of the upper cover 121 serves as the original feed tray. At this time, the sheet guide 119 forms the straight conveying path L3 for horizontally guiding the placed original to the CIS 105. With such configuration, originals made of a rigid and hard-to-bend material and originals such as thin paper, envelopes and small-sized paper can be easily conveyed. The second hinge 153 of the rear end cover 125 is located below the first hinge 151 so that the both hinges may not interfere with each other when the upper cover 121 is opened (pivotally moved by 180 degrees).

With the above-described configuration, in the image reading device, the original conveying path is formed for turning the original placed on the original feed tray in a substantially U-shape at the rear portion of the apparatus and then reading the original image and discharging the original onto the original feed tray. The openable cover (the rear end cover 125) is provided at the position where the original is turned in a substantially U-shape. Further, the straight conveying path which joins (merges with) the original conveying path by sending the original therefrom is provided.

As described above, in this aspect, all of operations of setting of the original and taking out of the discharged original and recording sheets can be performed on the front surface side of the apparatus. Moreover, the multifunction apparatus 1 is shaped like a box as a whole. Therefore, the multifunction apparatus 1 can be used with being accommodated in a shelf or the like has an excellent usability and requires only minimum installation space.

In the multifunction apparatus 1, all of operations of the operation panel 15, mounting and dismounting of the sheet supply cassette 21, and mounting and dismounting of the process unit 30 can be also performed on the front surface side of the apparatus. Since the apparatus is accessed from the front surface thereof in all cases as described above, excellent usability can be obtained.

In addition, the original feed tray 131 and the original discharge tray 141 are entirely covered with the side walls 12 of the casing 11 from the front ends to the rear ends. In other words, the side (widthwise) edges of the trays 131 and 141 are accommodated in the casing 11 and do not protrude to the outside. With such configuration, since the both trays 131 and 141 can be firmly held, impact resistance is significantly improved. More specifically, even when the multifunction apparatus 1 hits against the shelf wall in placing the apparatus in the shelf or in taking the apparatus out of the shelf, the impact is firstly applied to the casing 11. Accordingly, the impact applied to the trays 131 and 141 can be absorbed, thereby effectively protecting the trays 131 and 141.

<Second Aspect>

Figure 6A:
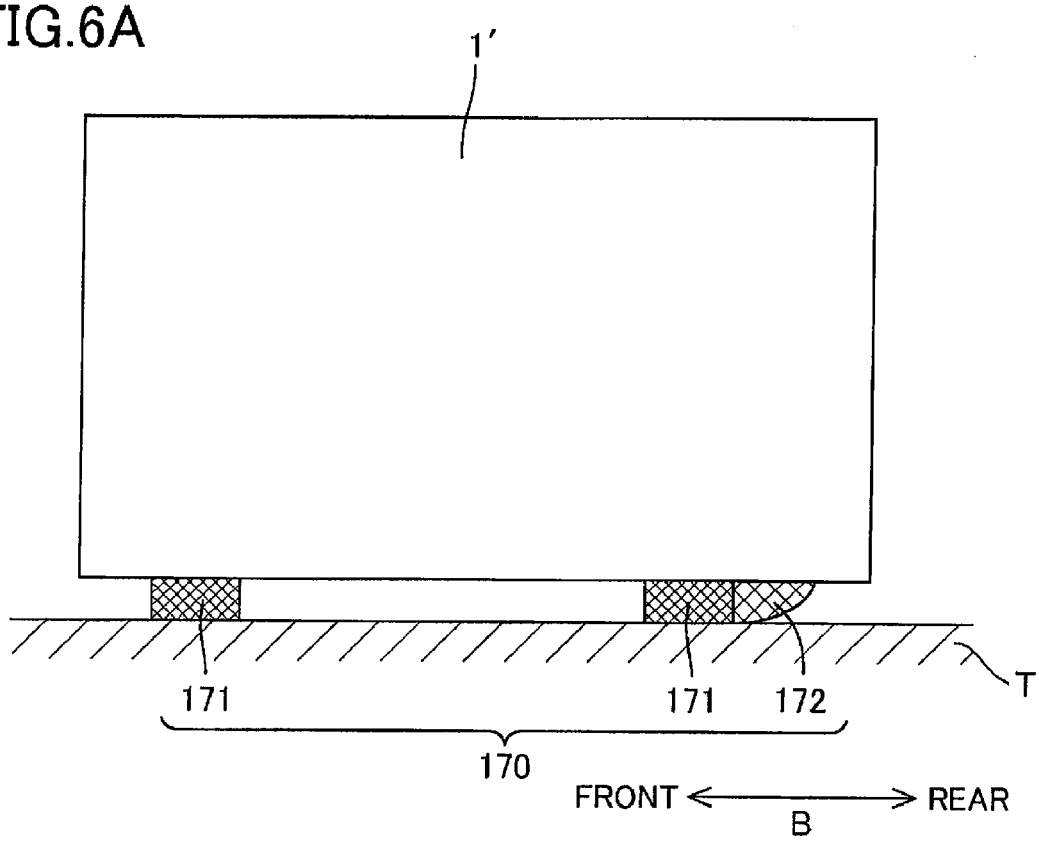
FIG. 6A is a side view of a multifunction apparatus according to a second aspect.

Next, an image forming apparatus according to a second aspect of the invention will be described with reference to FIGS. 6A and 6B, wherein like parts and components are designated by the same reference numerals to avoid duplicating description.

A multifunction apparatus 1' in the second aspect has load supporting members 170 for supporting the multifunction apparatus 1', in addition to the configuration of the multifunction apparatus 1 in the first aspect. The load supporting members 170 are provided at four corners on the lower surface of the multifunction apparatus 1'. The load supporting members 170 include load supporting members 171 disposed at the front portion and the rear portion of the apparatus. Each of the load supporting members 170 is made of rubber and is shaped like a rectangular parallelepiped. The load supporting members 170 also include load supporting members 172 which are disposed next to and at the rear of the rear-side load supporting members 171. Each of the load supporting members 172 is made of synthetic resin and has a smaller frictional coefficient than the rubber-made load supporting members 171 and has a substantially quarter-circular cross section.

Figure 6B:
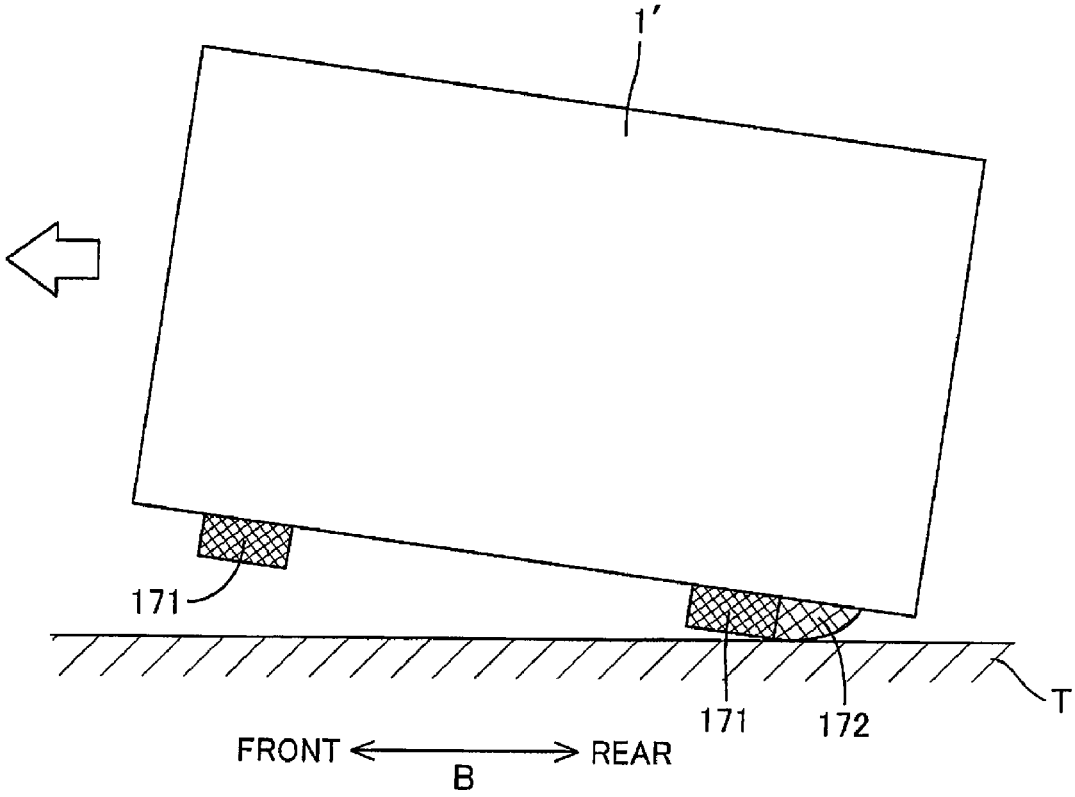
FIG. 6B is a side view of the multifunction apparatus shown in FIG. 6A, where the front end of the multifunction apparatus is lifted.

With such configuration, as shown in FIG. 6B, when the front end of the multifunction apparatus 1 is lifted, the load supporting members 172 having the smaller frictional coefficient support the apparatus and the arc-like parts are in contact with a surface T. Thus, merely by lightly pulling forward the multifunction apparatus 1 in this state, the apparatus can be smoothly taken out. That is, the multifunction apparatus 1 accommodated in the shelf can be taken out with a requisite minimum force. Since the load supporting members 171 having the larger frictional coefficient are in contact with the surface T during use (FIG. 6A), it is hard to slip. Consequently, the risk that the multifunction apparatus 1 falls out of the shelf can be decreased when vibration or the like is applied from the outside.

<Third Aspect>

Figure 7:
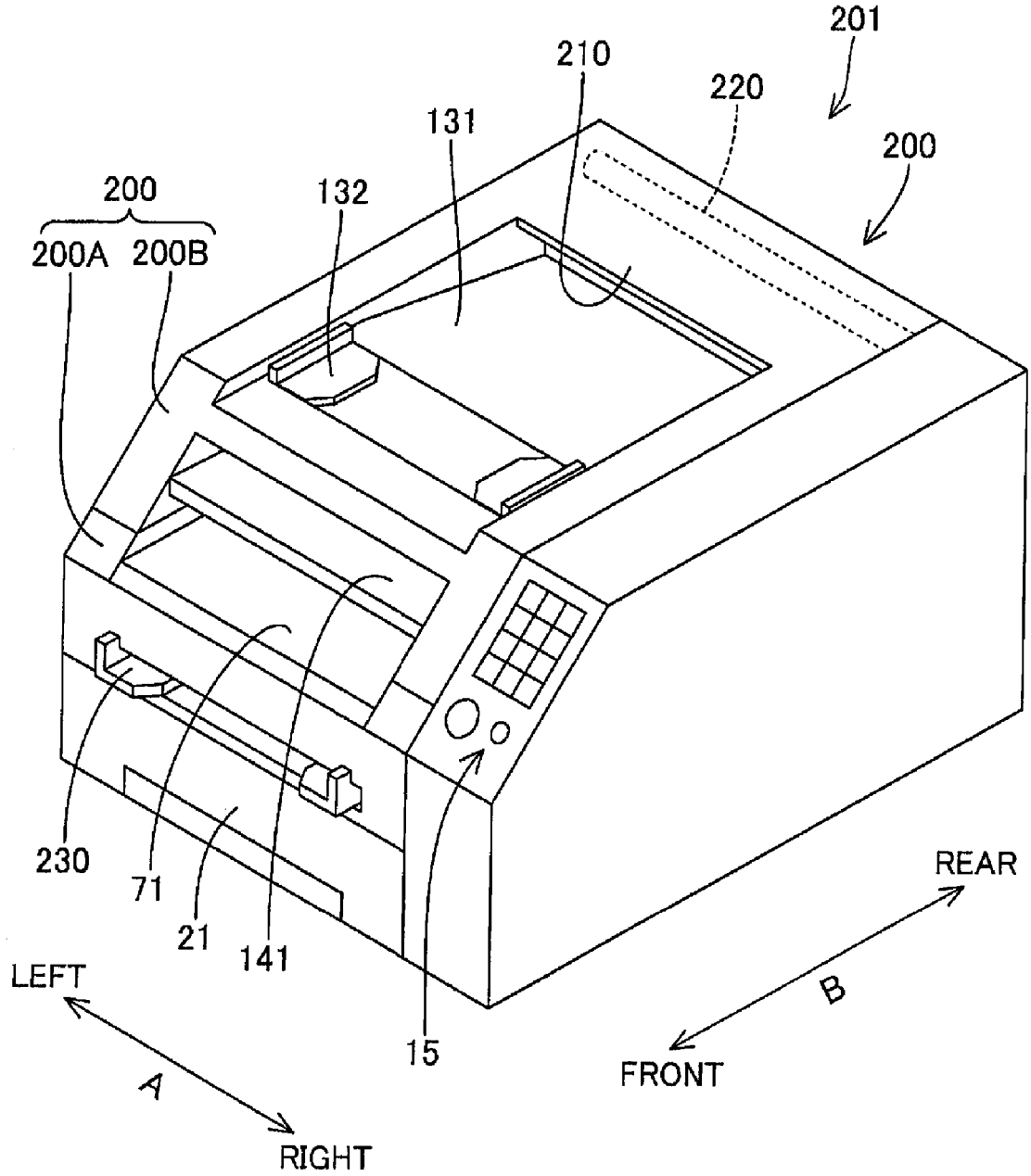
FIG. 7 is a perspective view showing a multifunction apparatus according to a third aspect.
Figure 8:
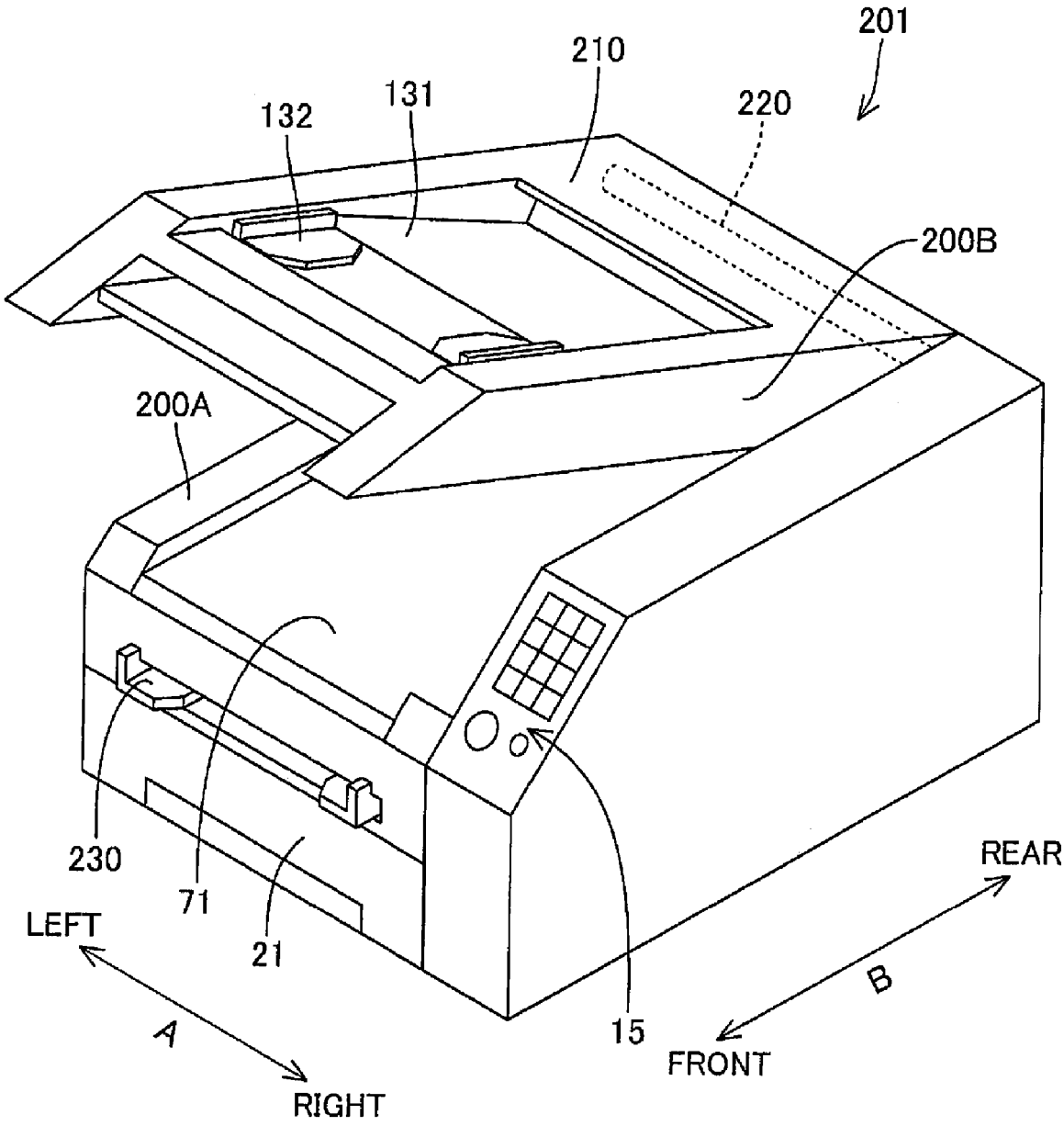
FIG. 8 is a perspective view of the multifunction apparatus in FIG. 7 for showing the state where a recording-sheet discharge tray is exposed.

Next, an image forming apparatus according to a third aspect of the invention will be described with reference to FIGS. 7 and 8, wherein like parts and components are designated by the same reference numerals to avoid duplicating description.

A multifunction apparatus 201 in the third aspect is formed by changing the configuration of the casing in the first aspect. The configuration of the other parts is basically the same as the configuration in the first aspect.

In the third aspect, a casing 200 is vertically divided into two parts between the recording-sheet discharge tray 71 and the original discharge tray 141. More specifically, the casing 200 includes a lower casing 200A and an upper casing 200B. Rear ends of the lower casing 200A and upper casing 200B are coupled to each other with a hinge 220. Thus, as shown in FIG. 8, the upper divided casing 200B can be pivotally moved, thereby enabling the upper surface of the recording-sheet discharge tray 71 to be exposed.

With such configuration, even when an image is printed on the recording sheet of small length (such as a postcard), the discharged recording sheet can be easily taken out. In the apparatus in this aspect, the upper cover 121 in the first aspect is formed integrally with the upper casing 200B (a part shown by a reference numeral 210 in FIGS. 7 and 8). With such configuration, rigidity of the casing can be improved, and thus the effect of protecting the trays 131 and 141 is improved.

In the multifunction apparatus 1 in this aspect, left side surfaces of the divided casings 200A and 200B are flush (i.e., positioned on the same imaginary plane) with each other so that the outer surfaces have no irregularity. With such configuration, the outer side surface of the tray holding member (the left side surface of the casing 200B in this aspect) is flush with the outer side surface of the casing (the left side surface of the casing 200A in this aspect). The manual feed tray 230 is also provided in this aspect.

<Fourth Aspect>

Figure 9:
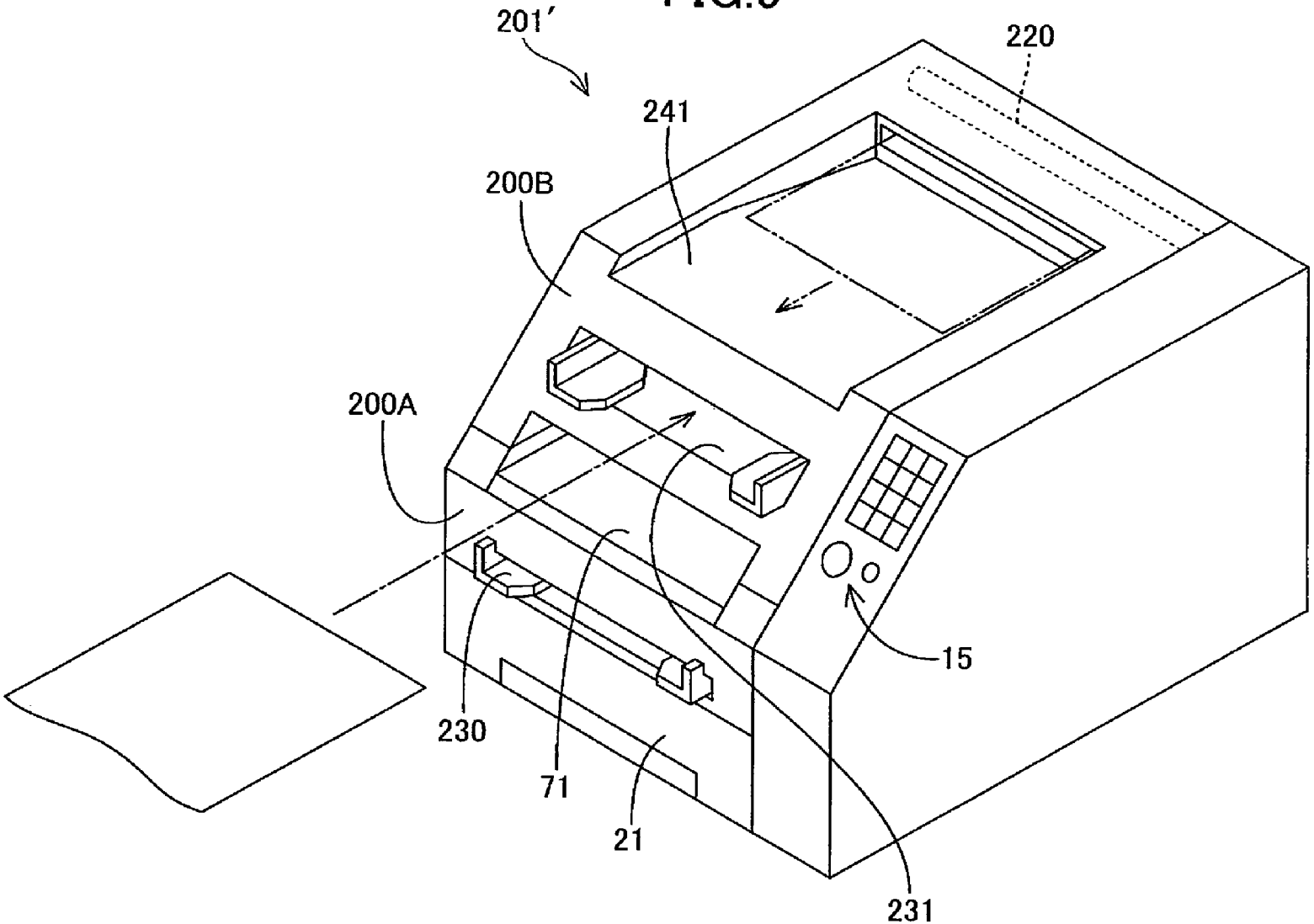
FIG. 9 is a perspective view of a multifunction apparatus according to a fourth aspect.

Next, an image forming apparatus according to a fourth aspect of the invention will be described with reference to FIG. 9, wherein like parts and components are designated by the same reference numerals to avoid duplicating description.

In a multifunction apparatus 201' in the fourth aspect, the arrangement of the original feed tray 131 and the original discharge tray 141 in the third aspect is vertically inversed. That is, an original feed tray 231 is located below an original discharge tray 241. The configuration of the other parts is the same as the configuration in the third aspect.

<Effects of the Aspects>

According to the image forming apparatus in the above-described aspects, since the trays 71, 131, and 141 and the sheet supply cassette 21 are covered with the side walls 12 (tray holding members) entirely from their front ends to rear ends, these components can be protected effectively.

Since an upper end of each side wall 12 is a flat surface, an object can be mounted on the surface. Furthermore, since the upper part of the apparatus has no protrusion, the apparatus can be easily inserted into a shelf.

The outer side surfaces of the side walls 12 are flush with the outer side surfaces of the casing 11. Since the outer surfaces have no irregularity or projection, the apparatus with such configuration is suitable to be placed on the shelf with a small space.

Since the process unit 30 can be inserted and removed from the front surface side, the apparatus has an excellent maintenance performance (the maintenance operation is easily performed).

In some aspects, the original feed tray 131 is disposed above the original discharge tray 141. With such configuration, the exposed area of the original feed tray 131 is larger than that of the original discharge tray 141. That is, an original can be set more easily, resulting in improvement of usability.

Since the front end of the original protrudes from the original discharge tray 141, the original can be easily taken by grasping the leading end.

An upper front end of the original reading device 100 is cut off in a slanted or curved (rounded) shape. With such configuration, danger can be effectively prevented. Moreover, it is possible to set the original on the original feed tray 131 and take the original out of the original discharge tray 141 more easily, leading to improvement of usability.

Since an opening of (or, a space above) the sheet discharge tray 71 can be made large by raising the front end of the original discharge tray 141, a sheet on which an image is formed can be easily taken out. Especially, small-sized paper such as postcards can be easily taken out.

With the straight conveying path L3, originals made of a rigid and hard-to-bend material and originals such as thin paper, envelopes and small-sized paper can be easily conveyed.

In the aspects in which the load supporting members are provided, even when the apparatus is accommodated in the shelf or the like, by raising and pulling the front end of the apparatus, the apparatus can be easily taken out. Since the load supporting members having the larger frictional coefficient are in contact with a shelf plate during use, it is hard to slip. Consequently, the risk that the apparatus falls out of the shelf when vibration or the like is applied from the outside can be decreased.

<Modifications>

While the invention has been described in detail with reference to the above aspects thereof, it would be apparent to those skilled in the art that various changes and modifications may be made therein without departing from the spirit of the invention.

(1) In the first aspect to the fourth aspect, the electrophotogaphic image forming apparatus is used as an example. However, the invention is not limited to this and for example, can be applied to an inkjet-type image forming apparatus.

Figure 10:
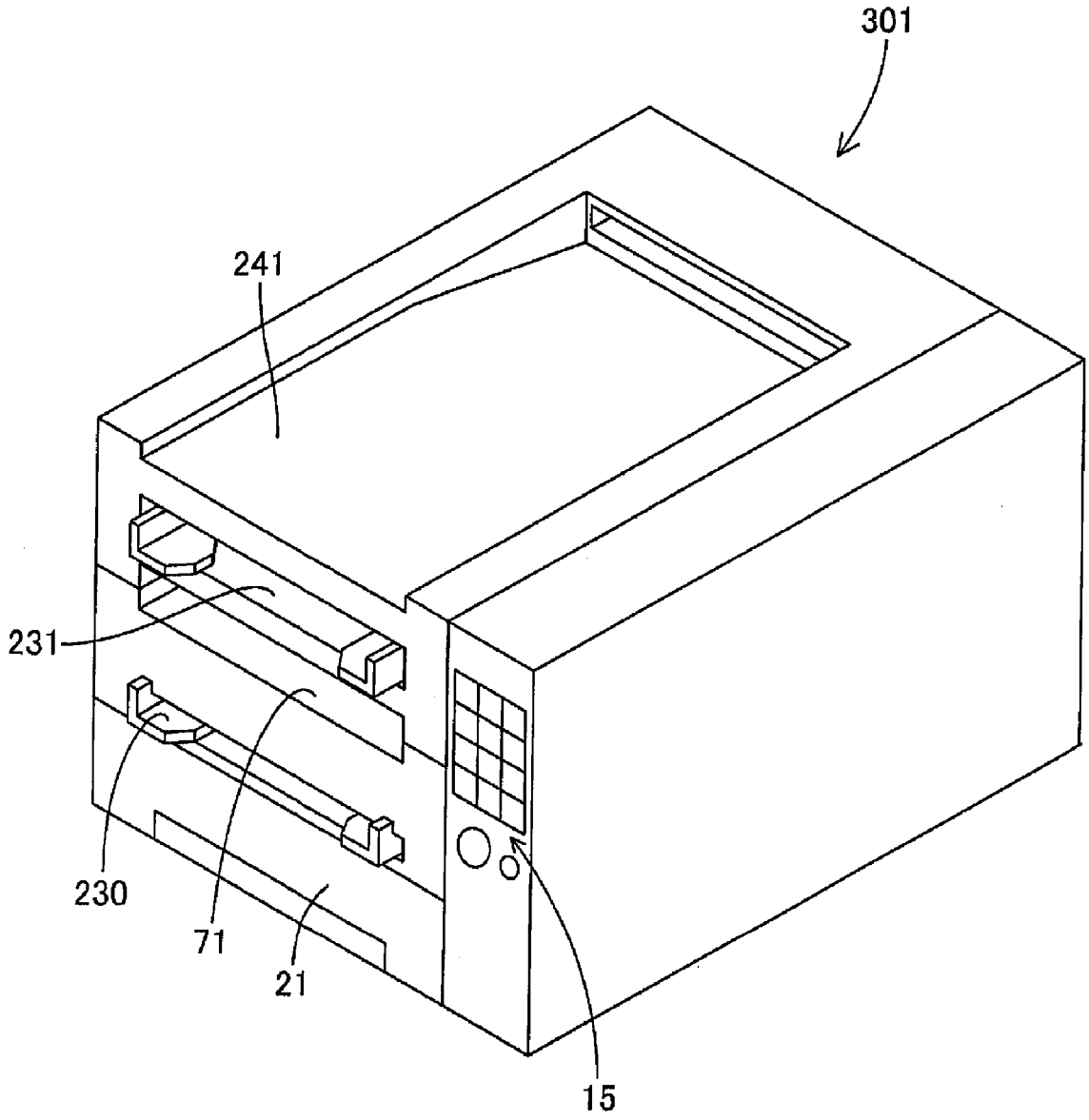
FIG. 10 is a perspective view showing a multifunction apparatus according to a modification.

(2) In the first aspect to the fourth aspect, the upper front end of the apparatus is obliquely cut off. However, as long as the apparatus is shaped like a box as a whole (both sides of each tray are covered with the side walls) and can be accessed from the front surface side, any type is acceptable. For example, as shown in FIG. 10, a multifunction apparatus 301 is shaped like a rectangular parallelepiped as a whole.

Figure 11A:
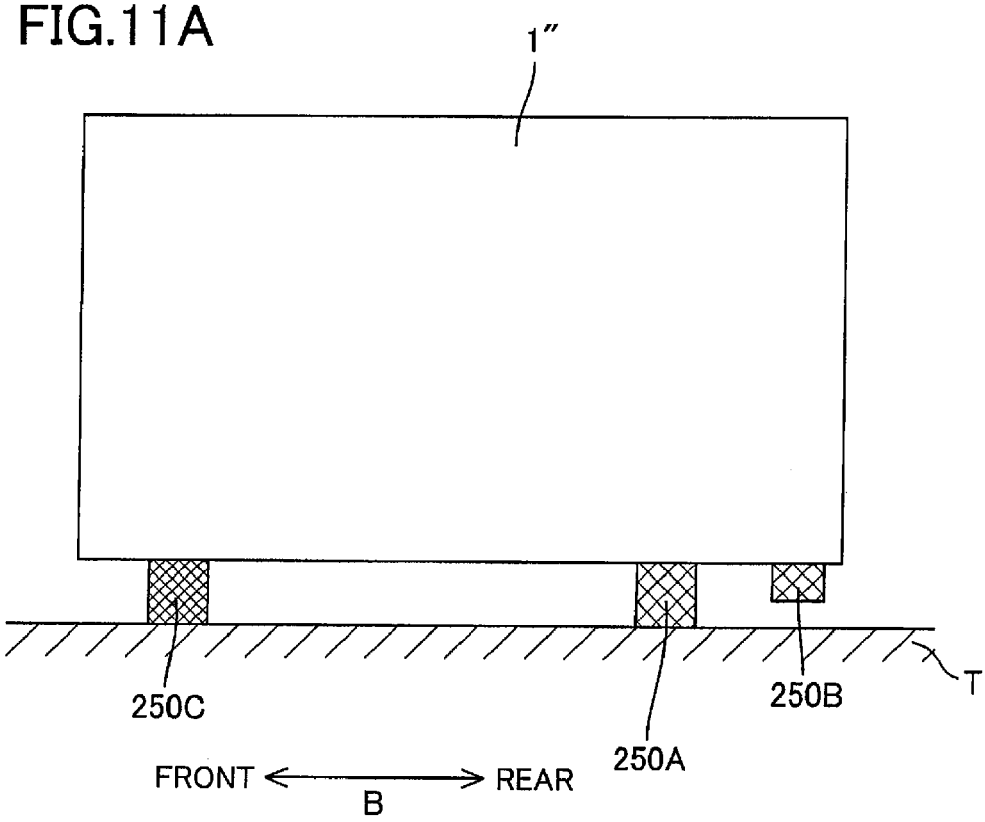
FIG. 11A is a side view showing a multifunction apparatus according to another modification.
Figure 11B:
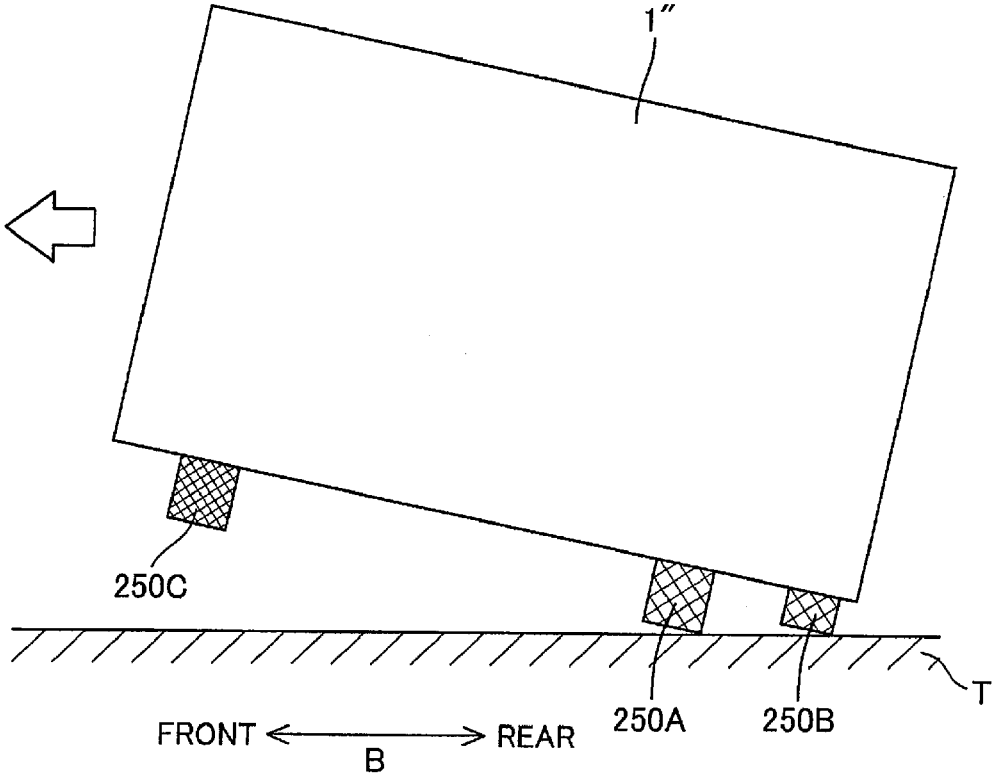
FIG. 11B is a side view showing the multifunction apparatus shown in FIG. 11A, where the front end of the multifunction apparatus is lifted.

(3) In the second aspect, both the rubber and resin load supporting members are disposed in the rear portion of the apparatus. However, the load supporting members having the smaller frictional coefficient only need to support the apparatus when the front end of the apparatus is lifted. For example, in a multifunction apparatus 1" shown in FIGS. 11A and 11B, all of the load supporting members located in the rear portion of the apparatus may be made of resin. More specifically, load supporting members 250C made of rubber are provided in the front portion of the apparatus. In addition, load supporting members 250A and 250B made of resin having different heights are provided in the rear portion of the apparatus. The load supporting members 250B have a smaller height than the load supporting members 250A. With this configuration, when the front end of the apparatus is lifted as shown in FIG. 11B, both the load supporting members 250A and 250B support the apparatus at two positions. Accordingly, the multifunction apparatus 1" can be pulled forward stably with a requisite minimum force. Further, in a normal state shown in FIG. 11A, the multifunction apparatus 1" is hard to slip because the rubber-made load supporting members 250C are in contact with the surface T.

(4) In the first aspect, the upper front end of the multifunction apparatus 1 is obliquely cut off. However, the upper front end may be cut off to be curved when viewed from the side. In this case, a curved and rounded surface is formed at the upper front end.

What is claimed is:

1. An image forming apparatus having an image reading function, comprising:

an apparatus main body comprising:

a main casing having one end and another end opposite the one end in a first horizontal direction, the main casing having both widthwise ends in a second horizontal direction perpendicular to the first horizontal direction, both the first horizontal direction and the second horizontal direction being horizontal and being perpendicular to a vertical direction when the image forming apparatus is disposed in an orientation in which the image forming apparatus is intended to be used, the main casing being formed with a sheet discharge opening;

a sheet supply cassette detachably mounted in the main casing, the sheet supply cassette being configured to accommodate a plurality of sheets in a stacked arrangement;

an image forming unit disposed in the main casing, the image forming unit being configured to form an image on a sheet supplied from the sheet supply cassette;

a sheet discharge tray that is disposed above the sheet supply cassette at an overlapping position with the sheet supply cassette in the vertical direction, the sheet discharge opening being positioned at an another end side of the sheet discharge tray; and a sheet discharge mechanism disposed in the main casing, the sheet discharge mechanism being configured to discharge the sheet, on which an image is formed, onto the sheet discharge tray through the sheet discharge opening; and an original reading device disposed on top of the apparatus main body, the original reading device comprising:

an original-reading-device main body formed with an original discharge opening;

an original feed tray on which an original is placed;

an image reading unit disposed in the original-reading-device main body, the image reading unit being configured to read an image on the original;

an original conveying mechanism disposed in the original-reading-device main body, the original conveying mechanism being configured to convey the original placed on the original feed tray toward the image reading unit;

an original discharge tray that is disposed at an overlapping position with the original feed tray in the vertical direction, the original discharge opening being positioned at an another end side of the original discharge tray;

an original discharge mechanism disposed in the original-reading-device main body, the original discharge mechanism being configured to discharge the original, from which the image is read, onto the original discharge tray through the original discharge opening;

a pair of side walls extending in the vertical direction, each of the side walls includes a tray holding member that form a pair of tray holding members disposed at both widthwise ends of the original feed tray and the original discharge tray in the second horizontal direction;

a hinge provided at another end side, in the first horizontal direction, of the one of the original feed tray and the original discharge tray; and another hinge that is provided at the main casing at an upper end in the vertical direction and at the another end in the first horizontal direction, wherein the pair of tray holding members support both the original feed tray and the original discharge tray at the both widthwise ends;

wherein the both widthwise ends of the original feed tray and the original discharge tray are formed as edge portions that extend in the first horizontal direction;

wherein each tray holding member of the pair of tray holding members has a shape that covers at least approximately one-half a length of each of the portions closest to the original discharge opening;

wherein one of the original feed tray and the original discharge tray is disposed directly above the sheet discharge tray;

wherein the one of the original feed tray and the original discharge tray is pivotally movable about the hinge, allowing a one end side of the one of the original feed tray and the original discharge tray to be movable in the vertical direction;

wherein the image reading device is coupled with the apparatus main body via the another hinge;

wherein the sheet discharge tray is provided on top of the main casing; and wherein sheet discharge tray is exposed when the image reading device is pivotally upwardly moved about the another hinge.

2. The image forming apparatus according to claim 1, wherein the pair of tray holding members has a shape that covers an entire length of each of the edge portions.

3. The image forming apparatus according to claim 1, wherein each tray holding member of the pair of tray holding members has a top surface that is substantially flat; and wherein the top surface is positioned upper than one of the original feed tray and the original discharge tray which is positioned upper than the other in the vertical direction.

4. The image forming apparatus according to claim 1, wherein one of the pair of tray holding members has an outer side surface that is positioned at an end in the second horizontal direction;

wherein the main casing has an outer side surface that is positioned at a same end as the outer side surface of the one of the pair of tray holding members; and wherein both of the outer side surface of the one of the pair of tray holding members and the outer side surface of the main casing are positioned on a same imaginary plane.

5. The image forming apparatus according to claim 1, wherein the image forming apparatus is an electrophotographic type image forming apparatus;

wherein the image forming unit comprises a process unit;

wherein the apparatus main body has a front cover that is provided at the one end of the main casing; and wherein the process unit is detachably mounted on the main casing by opening and closing the front cover.

6. The image forming apparatus according to claim 1, wherein the original discharge tray has a front end that is positioned at a one end side in the first horizontal direction; and wherein the original discharge tray has a length in the first horizontal direction that is shorter than an original having a predetermined size and having a leading edge, allowing the leading edge of the original to protrude toward the one end side from the front end of the original discharge tray.

7. The image forming apparatus according to claim 1, wherein the original reading device has either one of a shape formed by cutting off an upper-front corner portion obliquely and a shape formed by cutting off the upper-front corner portion to provide a curved surface, the upper-front corner portion being a corner portion located at a one end side in the first horizontal direction and at an upper side in the vertical direction.

8. An image forming apparatus having an image reading function, comprising:

an apparatus main body comprising:

a main casing having one end and another end opposite the one end in a first horizontal direction, the main casing having both widthwise ends in a second horizontal direction perpendicular to the first horizontal direction, both the first horizontal direction and the second horizontal direction being horizontal and being perpendicular to a vertical direction when the image forming apparatus is disposed in an orientation in which the image forming apparatus is intended to be used, the main casing being formed with a sheet discharge opening;

a sheet supply cassette detachably mounted in the main casing, the sheet supply cassette being configured to accommodate a plurality of sheets in a stacked arrangement;

an image forming unit disposed in the main casing, the image forming unit being configured to form an image on a sheet supplied from the sheet supply cassette;

a sheet discharge tray that is disposed above the sheet supply cassette at an overlapping position with the sheet supply cassette in the vertical direction, the sheet discharge opening being positioned at an another end side of the sheet discharge tray;

a sheet discharge mechanism disposed in the main casing, the sheet discharge mechanism being configured to discharge the sheet, on which an image is formed, onto the sheet discharge tray through the sheet discharge opening; and a hinge that is provided at the main casing at an upper end in the vertical direction and at the another end in the first horizontal direction; and an original reading device disposed on top of the apparatus main body, the original reading device comprising:

an original-reading-device main body formed with an original discharge opening;

an original feed tray on which an original is placed;

an image reading unit disposed in the original-reading-device main body, the image reading unit being configured to read an image on the original;

an original conveying mechanism disposed in the original-reading-device main body, the original conveying mechanism being configured to convey the original placed on the original feed tray toward the image reading unit;

an original discharge tray that is disposed at an overlapping position with the original feed tray in the vertical direction, the original discharge opening being positioned at an another end side of the original discharge tray;

an original discharge mechanism disposed in the original-reading-device main body, the original discharge mechanism being configured to discharge the original, from which the image is read, onto the original discharge tray through the original discharge opening; and a pair of tray holding members disposed at both widthwise ends of the original feed tray and the original discharge tray in the second horizontal direction, the pair of tray holding members supporting both the original feed tray and the original discharge tray at the both widthwise ends, wherein the image reading device is coupled with the apparatus main body via the hinge;

wherein the sheet discharge tray is provided on top of the main casing; and wherein sheet discharge tray is exposed when the image reading device is pivotally upwardly moved about the hinge.

9. An image forming apparatus having an image reading function, comprising:

an apparatus main body comprising:

a main casing having one end and another end opposite the one end in a first horizontal direction, the main casing having both widthwise ends in a second horizontal direction perpendicular to the first horizontal direction, both the first horizontal direction and the second horizontal direction being horizontal and being perpendicular to a vertical direction when the image forming apparatus is disposed in an orientation in which the image forming apparatus is intended to be used, the main casing being formed with a sheet discharge opening;

a sheet supply cassette detachably mounted in the main casing, the sheet supply cassette being configured to accommodate a plurality of sheets in a stacked arrangement;

an image forming unit disposed in the main casing, the image forming unit being configured to form an image on a sheet supplied from the sheet supply cassette;

a sheet discharge tray that is disposed above the sheet supply cassette at an overlapping position with the sheet supply cassette in the vertical direction, the sheet discharge opening being positioned at an another end side of the sheet discharge tray; and a sheet discharge mechanism disposed in the main casing, the sheet discharge mechanism being configured to discharge the sheet, on which an image is formed, onto the sheet discharge tray through the sheet discharge opening; and an original reading device disposed on top of the apparatus main body, the original reading device comprising:

an original-reading-device main body formed with an original discharge opening;

an original feed tray on which an original is placed;

an image reading unit disposed in the original-reading-device main body, the image reading unit being configured to read an image on the original;

an original conveying mechanism disposed in the original-reading-device main body, the original conveying mechanism being configured to convey the original placed on the original feed tray toward the image reading unit;

an original discharge tray that is disposed at an overlapping position with the original feed tray in the vertical direction, the original discharge opening being positioned at an another end side of the original discharge tray;

an original discharge mechanism disposed in the original-reading-device main body, the original discharge mechanism being configured to discharge the original, from which the image is read, onto the original discharge tray through the original discharge opening; and a pair of tray holding members disposed at both widthwise ends of the original feed tray and the original discharge tray in the second horizontal direction, the pair of tray holding members supporting both the original feed tray and the original discharge tray at the both widthwise ends, wherein the original-reading-device main body is formed with an original conveying path such that an original is placed on the original feed tray for feeding the original in a conveying direction, the conveying direction of the original is reversed in a substantially U-shape, an image on the original is read by the image reading unit, and the original is discharged onto the original discharge tray;

wherein an original casing cover is provided at the original-reading-device main body for providing the original conveying path in the substantially U-shape, the original casing cover being configured to pivotally open and close; and wherein the original-reading-device main body is formed with a straight conveying path when the original casing cover is open, the straight conveying path merging with the original conveying path.

10. The image forming apparatus according to claim 1, further comprising a plurality of load supporting members provided at a bottom of the apparatus main body for supporting the apparatus main body, wherein the plurality of load supporting members has different frictional coefficients, such that at least one of the plurality of load supporting members having a smaller frictional coefficient supports the apparatus main body when the one end of the apparatus main body is lifted.

11. The image forming apparatus according to claim 1, wherein all of the sheet supply cassette, the sheet discharge tray, the original feed tray, and the original discharge tray are oriented such that their lengthwise directions are aligned with the first horizontal direction.

12. The image forming apparatus having a image reading function comprising;

an apparatus main comprising:

a main casing having one end and another end opposite the one end in a first horizontal direction, the main casing having both widthwise ends in a second horizontal direction perpendicular to the first horizontal direction, both the first horizontal direction and the second horizontal direction being horizontal and being perpendicular to a vertical direction when the image forming apparatus is disposed in an orientation in which the image forming apparatus is intended to be used;

a sheet supply cassette detachably mounted in the main casing, the sheet supply cassette being configured to accommodate a plurality of sheets in a stacked arrangement;

an image forming unit disposed in the main casing, the image forming unit being configured to form an image on a sheet supplied from the sheet supply cassette;

a sheet discharge tray; and a sheet discharge mechanism disposed in the main casing, the sheet discharge mechanism being configured to discharge the sheet, on which an image is formed, onto the sheet discharge tray; and an original reading device disposed on top of the apparatus main body, the original reading device comprising:

an original feed tray on which an original is placed;

an image reading unit that is configured to read an image on the original;

an original conveying mechanism that is configured to convey the original placed on the original feed tray toward the image reading unit;

an original discharge tray; and an original discharge mechanism that is configured to discharge the original, from which the image is read, onto the original discharge tray;

a hinge provided at another end side, in the first horizontal direction, of the one of the original feed tray and the original discharge tray; and another hinge that is provided at the main casing at an upper end in the vertical direction and at another end in the first horizontal direction, wherein all of the sheet supply cassette, the sheet discharge tray, the original feed tray, and the original discharge tray are oriented such that their lengthwise directions are aligned with the first horizontal direction, and are arranged to overlap with one another in the vertical direction;

wherein the image forming apparatus further comprises a pair of side walls disposed at both widthwise ends, in the second horizontal direction, of the sheet supply cassette, the sheet discharge tray, the original feed tray, and the original discharge tray, the pair side walls extends in the vertical direction, each side wall includes a tray holding member that form a pair of tray holding members;

wherein the both widthwise ends of each of the sheet supply cassette, the sheet discharge tray, the original feed tray, and the original discharge tray are formed as edge portions that extend in the first horizontal direction;

wherein the pair of tray holding members covers an entire length of each of the edge portions, thereby supporting all of the sheet supply cassette, the sheet discharge tray, the original feed tray, and the original discharge tray;

wherein the one of the original feed tray and the original discharge tray is pivotally movable about the hinge, allowing a one end side of the one of the original feed tray and the original discharge tray to be movable in the vertical direction;

wherein the image reading device is coupled with the apparatus main body via the another hinge; and wherein sheet discharge tray is exposed when the image reading device is pivotally upwardly moved about the another hinge.

* * * * *